US006772687B2

(12) United States Patent
Damme et al.

(10) Patent No.: US 6,772,687 B2
(45) Date of Patent: Aug. 10, 2004

(54) METHOD FOR THE PREPARATION OF A LITHOGRAPHIC PRINTING PLATE

(75) Inventors: Marc Van Damme, Bonheiden (BE); Johan Loccufier, Zwijnaarde (BE)

(73) Assignee: AGFA-Gevaert, Mortsel (BE)

( * ) Notice: Subject to any disclaimer, the term of this patent is extended or adjusted under 35 U.S.C. 154(b) by 49 days.

(21) Appl. No.: 10/157,710

(22) Filed: May 29, 2002

(65) Prior Publication Data

US 2003/0089259 A1 May 15, 2003

Related U.S. Application Data

(60) Provisional application No. 60/308,288, filed on Jul. 27, 2001.

(30) Foreign Application Priority Data

Jun. 15, 2001 (EP) ..... 01000217

(51) Int. Cl.[7] ..... B41C 1/10
(52) U.S. Cl. ..... 101/465; 101/457; 101/462
(58) Field of Search ..... 101/457, 458, 101/459, 462, 463.1, 465, 466, 450.1; 347/95, 96, 100

(56) References Cited

U.S. PATENT DOCUMENTS 5,992,322 A * 11/1999 Fromson et al. ..... 101/457
6,187,380 B1 * 2/2001 Hallman et al. ..... 427/261
6,315,916 B1 * 11/2001 Deutsch et al. ..... 216/83
2002/0104455 A1 * 8/2002 Deutsch et al. ..... 101/463.1
2002/0139270 A1 * 10/2002 Nitzan et al. ..... 101/465
2003/0159607 A1 * 8/2003 Nitzan et al. ..... 101/466

FOREIGN PATENT DOCUMENTS

| | | |
|---|---|---|
| EP | 0 720 054 A | 7/1996 |
| EP | 0 771 645 | 5/1997 |
| GB | 2082 976 | 3/1982 |
| WO | 97 12759 | 4/1997 |
| WO | 97 21146 | 6/1997 |

* cited by examiner

*Primary Examiner*—Stephen R. Funk
(74) *Attorney, Agent, or Firm*—Joseph T. Guy; Nexsen Pruet , LLC

(57) ABSTRACT

A method for the preparation of a negative working lithographic printing plate is disclosed. A printing plate precursor comprising a lithographic support and an image forming layer is mounted on a printing press. A liquid containing a dissolution inhibitor is image-wise dispensed on the precursor by means of ink jet printing. The precursor is developed on press by the application of fountain and ink whereby the image areas are retained and the non-image areas are removed.

15 Claims, No Drawings

METHOD FOR THE PREPARATION OF A LITHOGRAPHIC PRINTING PLATE

This application claims the benefit of Provisional Application No. 60/308,288, filed Jul. 27, 2001.

FIELD OF THE INVENTION

The present invention relates to the preparation of a lithographic printing plate by means of direct ink jet printing.

BACKGROUND OF THE INVENTION

Traditional techniques of printing include letterpress printing, gravure printing and offset lithography. All of these printing methods require a plate, usually loaded onto a plate cylinder of a rotary press for efficiency, to transfer ink in the pattern of the image. In letterpress printing, the image pattern is represented on the plate in the form of raised areas that accept ink and transfer it onto the recording medium by impression. Gravure printing cylinders, in contrast, contain series of wells or indentations that accept ink for deposit onto the recording medium.

In the case of traditional offset lithography the image to be printed is present on a plate as a pattern of ink accepting (oleophilic) areas on an ink repellent (oleophobic or hydrophilic) background. In the wet system the required ink repellency is provided by an initial application of a dampening (or fountain) solution prior to inking. Conventional presensitized lithographic printing plates bear a UV sensitive coating based on photopolymer or diazonium chemistry. The plates have to be UV-exposed through a mask carrying the image. The mask is a graphic arts film prepared by photographic techniques based on silver halide chemistry and involving exposure by a camera or by an image-setter, and further involving wet processing. Depending on the type of plate used (negative or positive) the non-image areas or the image areas are solubilized thereby differentiating the plate into oleophilic and hydrophilic areas. A disadvantage of this traditional method is the necessary cumbersome preparation of the photographic intermediate film involving wet processing. A further drawback is the wet processing of the printing plate itself.

With the advent of the computer in revolutionizing the graphics design process leading to printing, there have been extensive efforts to develop a convenient and inexpensive computer-to-plate system wherein a photographic intermediate is no longer required. In recent years some of these systems are introduced into the market based on different chemical systems and exposure methods. For instance, the SETPRINT material, trade mark of Agfa-Gevaert N.V. is based on silver halide DTR chemistry and consists of a polyethylene terephthalate base carrying a photographic coating which after photo-mode exposure and processing produces complementary oleophilic and hydrophilic areas. Another system based on photo-mode exposure but with a hydrophilic aluminum base is LITHOSTAR, trade mark of Agfa-Gevaert N.V. A system based on heat mode exposure by means of an intense infra-red laser is called THERMOSTAR, also a trade mark of Agfa-Gevaert N.V.

Many of the new computer-to-plate systems are large, complex, and expensive. They are designed for use by large printing companies as a means to streamline the prepress process of their printing operations and to take advantage of the rapid exchange and response to the digital information of graphics designs provided by their customers. There remains a strong need for an economical and efficient computer-to-plate system for the many smaller printers who utilize lithographic printing.

A number of electronic, non-impact printing systems have been investigated for use in making lithographic printing plates to satisfy the needs of these smaller printers. Foremost among these have been laser printing systems, for example as described in U.S. Pat. No. 5,304,443 and references therein. Another non-impact printing system which has received attention for economical and convenient computer-to-plate preparation for lithographic printing is thermal transfer printing, for example, as described in U.S. Pat. No. 4,958,564.

In recent years, ink jet printers have replaced laser printers as the most popular hard copy output printers for computers. Some of the competitive advantages of ink jet printers are low cost and reliability. The ink jet printing system is a relatively rapid image output system and has a simple construction because it does not require any complex optical system. In recent times, there have been some reports in the literature proposing the use of ink jet printers to make lithographic printing plates.

In Japanese Kokai 62-25081, an oleophilic liquid or fluid ink was printed by ink jet printing onto a hydrophilic aluminum surface of a lithographic printing plate. Titanate or silane coupling agents were present in the ink.

An ink jet printing apparatus to make lithographic printing plates is described in PCT WO 94/11191. It is directed to depositing hydrophobic or hydrophilic substances on hydrophobic printing plates.

In U.S. Pat. No. 5,501,150, a fluid ink and hydrophilic media set containing materials to produce a silver-reducible image by ink jet printing are used to make a metallic silver image which, following wet processing to make the silver image sufficiently hydrophobic, is said to provide a lithographic printing plate.

Ink jet printing wherein the ink is a solid or phase change type ink instead of a liquid or fluid type ink is described in U.S. Pat. No. 4,833,486 to deposit a hot wax on a surface of an offset plate. Upon cooling of the wax, it solidifies, thereby providing a printing plate. Solid ink jet printing has serious disadvantages for lithographic plates in that the wax or resin image has limited durability due to its thermoplastic, chemical, and adhesive properties and the amount and rounded shape of the solidified ink jet droplet on the media do not have the intrinsic image resolution properties found in liquid ink jet printing.

There is also prior art in the use of ink jet printing to apply an opaque image or mask pattern to a photosensitive lithographic printing plate blank, as for example, in Japanese Kokai 63-109,052. The blank is then exposed through the ink jet imaged mask pattern and then processed by conventional means to provide a lithographic printing plate. This approach retains the materials and processing of conventional lithographic printing plates and only uses ink jet printing as an alternative for the photomask through which the conventional plates are exposed. Thus this approach adds to the complexity and expense of the platemaking process and does not depend on the ink jet ink image for the hydrophobic image of the plate. U.S. Pat. No. 5,495,803 describes a solid or phase change type of ink jet printing to form a photomask for a printing plate.

As a further example of the methods for preparing printing plates by using the ink jet printing system, Japanese Kokai Publication 113456/1981 proposes methods for preparing printing plates whereby ink-repelling materials (e.g. curable silicones) are printed on a printing plate by ink jet printing. The printing plate obtained by this method is an intaglio printing plate in which the ink-repelling material formed on the surface of the substrate serves as a non-image part. As a result, the resolution of the printed images at shadow area or reversed lines is not so good. Moreover, a large amount of ink is needed in this method because the ink-repelling material must be deposited on the whole non-image part which occupies most of the surface of the printing plate, thereby delaying the printing process.

U.S. Pat. No. 5,511,477 discloses a method for the production of photopolymeric relief-type printing plates comprising: forming a positive or a negative image on a substrate by ink jet printing with a photopolymeric ink composition, optionally preheated to a temperature of about 30°–260° C., and subjecting the resulting printed substrate to UV radiation, thereby curing said ink composition forming said image. This is an obnoxious method due to the sometimes high vapour pressure and toxicity of said inks.

U.S. Pat. No. 5,312,654 discloses a method for making lithographic printing plates comprising: forming an image on a substrate having an ink absorbing layer and a hydrophilized layer between the substrate and the absorbing layer by ink jet printing using a photopolymerizable ink composition, and exposing it to an actinic light in the wavelength region with which said ink composition is sensitized to cure the image. The printing endurance of said printing plates is low.

Japanese Kokai Publication 69244/1992 discloses a method for making printing plates comprising the steps of forming a printed image on a recording material subjected to a hydrophilic treatment by ink jet printing using a hydrophobic ink containing photocurable components, and exposing the whole surface to actinic light. However, the surface of the substrate to be used for the lithographic plate is usually subjected to various treatments such as a mechanical graining, an anodizing or a hydrophilic treatment to obtain good hydrophilic property and water retention property. Therefore, even the use of an ink composition having a very high surface tension results in a poor image on the surface of the substrate because of ink spreading and low printing endurance.

EP-A-533 168 discloses a method for avoiding said ink spreading by coating the lithographic base with an ink absorbing layer which is removed after ink printing. This is an uneconomical and cumbersome method.

Research Disclosure 289118 of May 1988 discloses a method for making printing plates with the use of an ink jet wherein the ink is a hydrophobic polymer latex. However said printing plates have a bad ink acceptance and a low printing endurance.

EP-A-003 789 discloses a process for the preparation of offset printing plates by means of an ink jet method with oleophilic inks. There is not indicated how said inks are made but from the examples it is clear that it concerns artificial latices, which are difficult to prepare.

JN-57/038142 discloses a method of preparing a printing plate by forming an ink image on a blank printing plate, and also by fixing this image thermally by making toner to adhere to this image-formed area. The composition of the ink is not mentioned, only the composition of the toners is disclosed.

JN-07/108667 discloses a plate-making method forming an ink image containing a hydrophilic substance on a conductive support whose surface layer is made hydrophilic according to an electrostatic attraction type ink set system to dry or cure the same, by applying bias voltage to the conductive support at the time of ink jet writing. This is a cumbersome process.

U.S. Pat. No. 5,213,041 discloses a method for preparing a reusable printing plate for printing, projecting an imaging deposit on the plate surface by jet printing using an ejectable substance containing a heat fusible component. The image forms an imaging deposit which is fused to the surface of the printing plate using a variable frequency and variable power induction heater.

According to WO 97/43122 a lithographic printing plate is manufactured by means of an ink jet fluid comprising reactive components selected from the group consisting of transition metal complexes and organic carbonyl compounds. In a preferred embodiment the reactive compound comprises one or more chromium complexes of an organic acid.

In WO 00/46034 a printable media is disclosed, including a substrate having a hydrophilic, porous layer on at least one surface, and an ink receptive, thermoplasic image layer adhered to the hydrophilic, porous layer, wherein the ink receptive layer contains a polymer having a low surface energy and a plurality of tertiary amine sites being at least partially neutralized with an acid. Further a method is disclosed wherein the polymer having tertiary amine sites is applied in a fluid by means of ink jet printing onto the hydrophilic porous layer. A similar fluid is disclosed in WO 00/46038.

In WO 97/39894 a heat-sensitive composition is disclosed and a method of making a lithographic printing form with it. On a lithographic base there is coated a complex of preferably a phenolic resin and a compound which forms a thermally frangible complex with the phenolic resin. This complex is less soluble in the developer solution than the uncomplexed phenolic resin. Further a laser absorbing material can be present. When the complex is image-wise heated, e.g. by high-power IR-irradiation, the complex breaks down so allowing the non-complexed phenolic resin to be dissolved in the developing solution. A positive working printing form is obtained. This teaching is further elaborated in WO 98/42507 wherein specific dissolution inhibitors are disclosed.

In EP 864420 there is provided a heat-sensitive imaging element for making positive working lithographic printing plates comprising on a lithographic base a layer comprising a polymer, soluble in an aqueous alkaline solution and an IR-sensitive top layer. Upon image-wise exposure the capacity of the aqueous alkaline solution to penetrate or solubilize the top layer is changed.

The lithographic printing plate precursors based on heat mode according to the above cited references show the drawback that they require a complicated and expensive platesetter apparatus equipped with an an expensive and short-living high power IR exposure unit. Furtheron their working mode is limited to positive working.

In European patent application appl. No. 01000150 a method is disclosed for the preparation of a negative working lithographic printing plate by means of ink jet printing. This method uses a lithographic printing plate precursor comprising a lithographic support and an image forming layer containing a polymeric binder soluble in an aqueous alkaline developer. The precursor is image-wise printed by an ink jet fluid comprising a compound capable of reducing the solubility of said binder in said aqueous alkaline developer. After development a negative working printing plate is obtained.

A disadvantage of this system and of most systems disclosed in the references cited above is the need for a processing off press, so that separate processing equipment and chemicals are required.

OBJECTS OF THE INVENTION

It is an object of the present invention to provide a method for the preparation of a lithographic printing plate whereby the plate can be developed by fountain and/or ink on press, so that no separate processing equipment or chemicals are required.

It is a further object of the present invention to provide a method for the preparation of a lithographic printing plate which has the same plate and lithographic chracteristics as a conventional plate.

It is a further object of the present invention to provide a method for the preparation of a lithographic printing plate which is uncomplicated and requires only a relatively cheap ink jet printer.

SUMMARY OF THE INVENTION

The above mentioned objects are realised by providing a method for the preparation of a lithographic printing plate comprising the following steps, in order, :

(1) mounting on a printing press a printing plate precursor comprising a lithographic support and an image forming layer, capable of being dissolved and removed by the application of fountain and/or ink on said press, (2) prior to, or after step (1), dispensing image-wise by means of ink jet printing droplets of a fluid onto the surface of said lithographic printing plate precursor, characterized in that said fluid comprises in a solvent carrier a dissolution inhibitor compound capable of inhibiting or reducing the dissolving and removing action of fountain and/or ink on said image forming layer, (3) drying the plate precursor to at least partially remove the solvent carrier of said fluid, (4) applying fountain and/or ink onto the dried plate precursor, thereby removing the areas of said image forming layer, not imaged by ink jet printing, and simultaneously exposing the surface of said lithographic support, while retaining completely or at least partially the areas of said image forming layer, imaged by ink jet printing.

In a preferred embodiment the image forming layer comprises an anionically stabilized monomer.

DETAILED DESCRIPTION OF THE INVENTION

The essential elements of the present invention being the composition of the printing plate precursor and of the ink jet fluid will now be explained in detail.

Composition of the Lithographic Printing Plate Precursor (a) The Lithographic Support The support may be any support suitable for printing plates. Typical supports include metallic and polymeric sheets or foils. Preferably, a support having a metallic surface is used. Preferably, the metallic surface is oxidized. In a particularly preferred embodiment of the invention, a support having an anodised aluminum surface is employed. The support for the lithographic printing plate is typically formed of aluminum which has been grained, for example by electrochemical graining, and then anodised, for example, by means of anodising techniques employing sulphuric acid and/or phosphoric acid. Methods of both graining and anodising are very well known in the art and need not be further described herein. After writing the image the printing plate can be inked with printing ink in the normal way, and the plate can be used on a printing press. Before inking the plate can be treated with an aqueous solution of natural gum, such as gum acacia, or of a synthetic gum such as carboxymethyl cellulose, as it is well known in the art of printing.

According to another mode in connection with the present invention the lithographic base with a hydrophilic surface comprises a flexible support, such as e.g. paper or plastic film, provided with a cross-linked hydrophilic layer. A particularly suitable cross-linked hydrophilic layer may be obtained from a hydrophilic binder cross-linked with a cross-linking agent such as formaldehyde, glyoxal, polyisocyanate, melamine type cross-linkers, ammonium zirconyl carbonate, titanate crosslinkers, or a hydrolysed tetraalkylorthosilicate. The latter is particularly preferred.

As hydrophilic binder there may be used hydrophilic (co)polymers such as, for example, homopolymers and copolymers of vinyl alcohol, acrylamide, methylol acrylamide, methylol methacrylamide, acrylate acid, methacrylate acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60 percent by weight, preferably 80 percent by weight.

The cross-linked hydrophilic layer in a lithographic base used in accordance with the present embodiment preferably also contains substances that increase the mechanical strength and the porosity of the layer e.g. metal oxide particles which are particles of titanium dioxide or other metal oxides. It is believed that incorporation of these particles gives the surface of the cross-linked hydrophilic layer a uniform rough texture consisting of microscopic hills and valleys which serve as storage places for water in background areas. Preferably these particles are oxides or hydroxydes of beryllium, magnesium, aluminium, silicon, gadolinium, germanium, arsenic, indium, tin, antimony, tellurium, lead, bismuth, titanium or a transition metal. Particularly suitable inorganic particles are oxides or hydroxides of aluminum, silicon, zirconium or titanium, used in at most 75% by weight of the hydrophilic layer. The inorganic pigments may have have a particle size ranging from 0.005 $\mu$m to 10 $\mu$m.

Particular examples of suitable cross-linked hydrophilic layers for use in accordance with the present invention are disclosed in EP-A-601 240, GB-P-1 419 512, FR-P-2 300 354, U.S. Pat. No. 3,971,660, U.S. Pat. No. 4,284,705 and EP-A-514 490.

As flexible support of a lithographic base in connection with the present embodiment it is particularly preferred to use a plastic film e.g. substrated polyethylene terephthalate film, substrated polyethylene naphthalate film, cellulose acetate film, polystyrene film, polycarbonate film etc. The plastic film support may be opaque or transparent.

(b) The Image Forming Layer

The main characteristic of the image forming composition is its capability of being removed on-press by the action of fountain and/or ink. In a preferred embodiment the layer is characterised in that it contains at least one anionically stabilised compound. The anionic nature of the image forming layer prevents destabilization of the press when the layer is removed on the press by the fountain and/or ink.

The anionic compound can be an anionically stabilized polymer particle or an anionic functional polymer.

The anionically stabilized polymer particle can be an anionic polymer prepared by emulsion polymerization, an anionically stabilized polymer bead or an anionic polymer dispersion. The anionically stabilized polymer particles are preferentially not film forming at room temperature.

Anionically stabilised polymer particles can be prepared by emulsion polymerization using anionic surfactants.

As monomers can be used: styrene, p.-methylstyrene, tert.-butylstyrene, methylmethacrylate, ethylmethacrylate, butylmethacrylate, glycidylmethacrylate, hydroxyethylmethacrylate, α-methylstyrene, ethylacrylate, butylacrylate, vinyl acetate, vinyl versatate, butadiene, isoprene, acrylonitrile, methacrylonitrile, sulfoethyl methacrylate and its alkali salts, acrylic acid, methacrylic acid, tert-butyl acrylamide, AMPS, N-isopropylacrylamide, itaconic acid, maleic acid, maleic anhydride, isopropylmethacrylate, dialkyl itaconate, acrylonitrile, methacrylonitrile, meta-isopropenyl dimethyl isocyanate (TMI), tert.-butyl methacrylate, 4-methyl-2,4-diphenyl-1-pentene, 2,2-dimethyl-4-methylene-pentanedioic acid dimethyl ester, allyl methacrylate and vinyl chloride.

Particular examples of anionic surfactants are fatty alcohol sulphates, alkylphenol sulphates, fatty alcohol ether sulphates, fatty alcohol ether sulphates, alkylphenol ether sulphates, alkylbenzene sulphonic acid, alkyl ether carboxylic acid and salts thereof, alkyl sulphosuccinates, alkyl sulphosuccinamates, phosphate esters, α-olefine sulphonates, etc.

The particle size obtained with emulsion polymerization ranges from 30 nm to 300 nm. Preferably particles are used with a diameter between 30 nm and 200 nm.

Anionically stabilized polymer beads can also be used in this invention. Methods for the preparation of such beads can be found in:

*Preparation of monodisperse spherical polymer particles*, Harrison, David Bryan; Podszun, Wolfgang; Louwet, Frank; (Agfa-Gevaert AG) EP 995764

*Crosslinked homodisperse polymer particles*, Louwet, Frank; De Clercq, Ronny; Geudens, Johan; De Winter, Walter. *Des. Monomers Polym.* (1998), 1(4), 433-445.

*Method for preparing solvent-resistant polymer beads*, Timmerman, Daniel Maurice; Van Thillo, Etienne Adrianus; Muys, Bavo August. (Agfa-Gevaert N.V.) EP 466982

*Stable aqueous dispersions of polymer beads and the use of these dispersions in photographic elements*, Timmerman, Daniel Maurice; Priem, Jan Jozef; Janssens, Wilhelmus. (Agfa-Gevaert N. V.) EP 80225

*Dispersion process for preparation of spherical polymers*, Podszun, Wolfgang; Kruger, Joachim; Halle, Olaf; Louwet, Frank. (Agfa-Gevaert AG). EP 897939

U.S. Pat. Nos. 5,234,890 and 4,833,060.

Polymer dispersions which are anionically stabilized are also useful in this invention. Many dispersion technologies are known to the expert in the field to obtain stable polymer dispersion. The polymer can be based on polyvinylchloride, polyvinyl acetate, polyvinyl phenol, polyvinyl halogenated phenol, polyvinyl formal, polyvinyl acetal, polyvinyl butyral, polyamide, polyurethane, polyurea, polyimide, polycarbonate, epoxy resin, novolak, condensation resins of resol phenols with aldehyde or ketone, polyvinylidene chloride, polystyrene, acryl-based copolymerization resins, etc.

The anionic compound can also be an anionic functional polymer. Such polymers can be prepared by (co) polymerizing anionic functional monomers. Preferably such monomers include as functional groups the salts of sulphonic acid, sulphuric acid, carbocylic acid, phosphonic acid, phosphoric acid. Examples of such monomers are :

2-Acrylamido-2-methyl-1-propanesulphonic acid (AMPS), sulpho isophtalic acid, sulpho ethyl methacrylate, 2-(sodiosulpho) ethylmethacrylate, (sulphoxyalkyl) acrylates or methacrylates, styrene sulphonic acid, diazosulphonate monomers like methacrylamidophenyl diazosulphonate, allyl ethoxy sulphates, 1-allyloxy-2-hydroxypropyl sulphonate, vinylsulphonic acid, Sulphuric acid monoethenyl ester (vinyl sulphuric acid), mono-2-propenyl ester of sulphuric acid, Sulphuric acid monovinyl ester (vinyl sulphuric acid), Sulphatoethyl methacrylate (Bisomer SEM), Methacrylic acid 2-hydroxyethanesulphonic acid ester (sulphoethyl methacrylate=SEM), phosphoric acid esters of vinyl alcohol, vinylbenzenesulphonic acid, sulphuric acid esters of vinyl alcohol, itaconic acid, maleic acid, crotonic acid, acrylic acid, methacrylic acid, fumaric acid, monoacryloxyethyl phosphate, monomethacryloxyethyl phosphate, methacrylic acid 2-hydroxyethyl phosphonate ester, acrylic acid 2-hydroxyethyl phosphonate ester, 4,4-bis(hydroxyphenyl) pentanoic acid, trimellitic anhydride, monoalkyl maleates, monoalkyl fumarates, 2-methyl-2-propene-1-sulfonic acid, vinyl phosphate (phosphoric acid monovinyl ester), allylphosphonic acid, vinylphosphonic acid, methyl vinylphosphonate, monomethyl allylphosphonate, phosphoric acid monoethenyl monomethyl ester, allyl alcohol monophosphoric ester, dimethylolacetic acid, 4-hydroxy-2-(2-hydroxyethyl)-2-methyl-butanoic acid, dimethylolpropionic acid, and their salts.

These monomers can be copolymerized with known monomers such as:

(A) acrylamides, methacrylamides, acrylates, methacrylates, hydroxystyrenes, each having an aromatic hydroxyl group, e.g., N-(4-hydroxyphenyl) acrylamide, N-(4-hydroxyphenyl)-methacrylamide, o-, m- and p-hydroxystyrene, o-, m- and p-hydroxyphenyl acrylate or methacrylate (B) acrylates and methacrylates each having an aliphatic hydroxyl group, e.g., 2-hydroxyethyl acrylate, or 2-hydroxyethyl methacrylate (C) (substituted) acrylates, e.g., methyl acrylate, ethyl acrylate, propyl acrylate, butyl acrylate, amyl acrylate, hexyl acrylate, cyclohexyl acrylate, octyl acrylate, phenyl acrylate, benzyl acrylate, 2-chloroethyl acrylate, 4-hydroxybutyl acrylate, glycidyl acrylate, and N-dimethylaminoethyl acrylate, etc.

(D) (substituted) methacrylates, e.g., methyl methacrylate, ethyl methacrylate, propyl methacrylate, butyl methacrylate, amyl methacrylate, hexyl methacrylate, cyclohexyl methacrylate, octyl methacrylate, phenyl methacrylate, benzyl methacrylate, 2-chloroethyl methacrylate, 4-hydroxybutyl methacrylate, glycidyl methacrylate, and N-dimethylaminoethyl methacrylate, etc.

(E) acrylamide or methacrylamide, e.g., acrylamide, methacrylamide, N-methylolacrylamide, N-methylolmethacrylamide, N-ethylacrylamide, N-ethylmethacrylamide, N-hexylacrylamide, N-hexylmethacrylamide, N-cyclohexylacrylamide, N-cyclohexylmethacrylamide, N-hydroxyethylacrylamide, N-hydroxyethylmethacrylamide, N-phenylacrylamide, N-phenylmethacrylamide, N-benzylacrylamide, N-benzylmethacrylamide, N-nitrophenylacrylamide, N-nitrophenylmethacrylamide, N-ethyl-N-phenylacrylamide, and N-ethyl-N-phenylmethacrylamide, etc.

(F) vinyl ethers, e.g., ethyl vinyl ether, 2-chloroethyl vinyl ether, hydroxyethyl vinyl ether, propyl vinyl ether, butyl vinyl ether, octyl vinyl ether, phenyl vinyl ether, etc.

(G) vinyl esters, e.g., vinyl acetate, vinyl chloroacetate, vinyl butyrate, vinyl benzoate, etc.

(H) styrenes, e.g., styrene, methylstyrene, chloromethylstyrene, etc.

(I) vinyl ketones, e.g., ethyl vinyl ketone, propyl vinyl ketone, phenyl vinyl ketone, etc.

(J) olefins such as ethylene, propylene, isobutylene, butadiene, isoprene, etc.

(K) N-vinylpyrrolidone, N-vinylcarbazole, N-vinylpyridine, acrylonitrile, methacrylonitrile, etc.

(L) acrylamides, e.g., N-(o-aminosulfonylphenyl) acrylamide, N-(m-aminosulfonylphenyl)acrylamide, N-(p-aminosulfonylphenyl)acrylamide, N-[1-(3-aminosulfonyl)naphthyl]acrylamide, and N-(2-aminosulfonylethyl)acrylamide, methacrylamide, e.g., N-(o-aminosulfonylphenyl)methacrylamide, N-(m-aminosulfonylphenyl)methacrylamide, N-(p-aminosulfonylphenyl)methacrylamide, N-[1-(3-aminosulfonyl)naphthyl]methacrylamide, and N-(2-aminosulfonylethyl)methacrylamide, unsaturated sulfonamides such as acrylate, e.g., o-aminosulfonylphenyl acrylate, m-aminosulfonylphenyl acrylate, p-aminosulfonylphenyl acrylate, and 1-(3-aminosulfonylphenylnaphthyl) acrylate, and unsaturated sulfonamides such as methacrylate, e.g., o-aminosulfonylphenyl methacrylate, m-aminosulfonylphenyl methacrylate, p-aminosulfonyiphenyl methacrylate, and 1-(3-aminosulfonylphenylnaphthyl) methacrylate.

The anionic polymer may also be derived from natural polymers, like alginic acid, carboxymethyl cellulose (CMC), oxidised starch, dextran sulfate, ect. and their salts.

Furthermore the anionic polymer may prepared by polymer analogous reactions, e.g. sulfonated polyurethanes, alkali treated anhydride copolymers, modification of hydroxy functional polymers with anhydrides (e.g. reaction products of polyvinylalcohol with phtalic acid anhydride or maleic acid anhydride).

A preferred class of anionic compounds are polymers containing azosulphonate functional groups. Useful examples of such polymers are polymers having aryldiazosulphonate units and aryltriazenylalkanesulfonate units. Examples of such polymers are described in European patent applications appl. Nos. 99200846 and 99200847.

Additionally the image forming layer may comprise polymers, dyes and surfactants. Polymers can be added to improve the image durability or the on-press processing characteristics. Hydrophilic binders as described in EP 0 931 647 are preferred.

The dry coverage of the image forming layer is preferably comprised between 0.20 and 2 g/m$^2$, most preferably between 0.25 and 1.5 g/m$^2$.

The image forming layer can be UV-sensitive. An advantage of a plate comprising such layer is the fact that it can also be used in a conventional plate preparation using an analogue UV-exposure through a film. However, preferably the image forming layer is not substantially influenced by incident UV-radiation. This allows to use the plate making system in daylight conditions without the use of safelight.

Fluid Formulation

The novel ink jet fluid marking material of the present invention comprises a liquid carrier and at least one 'insolubilizing compound'. These insolubilizing compounds are believed to complex/interact with the anionic compound in the image forming layer resulting in a decreased solubility in the fountain and/or ink.

Preferably the insolubilizing compounds are cationic compounds. Both low molecular weight and high molecular weight compounds can be used.

A useful class of insolubilizing compounds are nitrogen-containing compounds wherein a least one nitrogen atom is either quaternized, incorporated in a heterocyclic ring or quaternized and incorporated in a heterocyclic ring. Examples of useful quaternized nitrogen containing compounds are triaryl methane dyes such as Crystal Violet (CI Basic Violet 3) and Ethyl Violet and tetraalkyl ammonium compounds.

More preferably the insolubilizing compound is a nitrogen-containing heterocyclic compound. Examples of suitable nitrogen-containing heterocyclic compounds are quinoline and triazoles, such as 1,2,4-triazole.

More preferably the insolubilizing compound is a quaternized heterocyclic compound. Examples of suitable quaternized heterocyclic compounds are imidazolinium compounds, such as MONAZOLINE C, MONAZOLINE O, MONAZOLINE CY and MONAZOLINE T all of which are trade names of Mona Industries, quinolinium compounds, such 1-ethyl-2-methyl quinolinium iodide and 1-ethyl-4-methyl quinolinium iodide, and benzothiazolium compounds, such as 3-ethyl-2-methyl benzothiazolium iodide, and pyridinium compounds, such as cetyl pyridinium bromide, ethyl viologen dibromide and fluoropyridinium tetrafluoroborate.

Useful quinolinium or benzothiazolium compounds include cationic cyanine dyes, such as Quinoldine Blue and 3-ethyl-2-[3-(3-ethyl-2(3H)-benzothiazolylidene)-2-methyl-1-propenyl] benzothiazolium iodide.

Other useful insolubilizing compounds are ferrocenium compounds, such as ferrocenium hexafluorophosphate.

Another preferred class of insolubilizing compounds is constituted by the onium salts. Suitable onium salts include iodonium, sulphonium, bromonium, chloronium, oxysulphonium, sulphoxonium, selenomium, and telluronium. Such compounds are described in U.S. Pat. No. 4,708,925.

The insolubilizing compounds may be present in the ink in an amount from 0.01 to 10, preferably from 0.1 to 8% by weight.

It is necessary that the insolubilizing compounds is in the form of a homogeneous solution or a stable colloidal dispersion, so that it can pass through the nozzles of the printhead.

The liquid carrier is water or organic solvents or combinations thereof. Choice of the specific liquid carrier depends on the specific ink jet printer and its compatibility with the ink jet printing head and cartridge being used for the ink jet printing. Both aqueous based and solvent based inks can be used in the present invention depending on the ink-jet technology that is being used: piezo, thermal, bubble jet or continuous ink jet.

While water is the preferred medium for aqueous inks, the aqueous composition may comprise one or more water-miscible solvents e.g. a polyhydric alcohol such as ethylene glycol, diethylene glycol, triethylene glycol or trimethylol propane. The amount of aqueous carrier medium in the aqueous composition may be in the range from 30 to 99.995, preferably from 50 to 95% by weight.

Also organic solvents may be used as a carrier medium for the ink e.g. alcohols, ketones or acetates.

As known for the ink jet technology, the jet velocity, separation length of the droplets, drop size and stream stability is greatly affected by the surface tension and the viscosity of the aqueous composition. Ink jet inks suitable for use with ink-jet printing systems may have a surface tension in the range from 20 to 60, preferably from 30 to 50 dynes/cm. Control of surface tensions in aqueous inks may be accomplished by additions of small amounts of surfactants. The amount of surfactants to be used can be determined by simple trial and error experiments. Several anionic and nonionic surfactants are known in the ink jet art. Commercial surfactants include the SYRFINOL TM series, trade name from Air Products; the ZONYL TM series, trade name from DuPont; the FLUORAD TM series, trade name from 3M, and the AEROSOL TM series, trade name from Cyanamid. The viscosity of the ink is preferably not greater than 20 mPa.s, e.g. from 1 to 10, preferably from 1 to 5 mPa.s at room temperature.

The ink may further comprise other ingredients. A co-solvent may be included to help prevent the ink from drying out in the orifices of the print head. A biocide may be added to prevent unwanted microbial growth which may occur in the ink over time. Additional additives that may be optionally present in the ink include thickeners, pH adjusters, buffers, conductivity enhancing agents, drying agents, humectants and defoamers.

In order to enhance the image contrast after jetting the image on a lithographic receiver, dyes can be added. Many dyes and pigments are known to be suited for the ink jet technology. Suitable dyes are further selected based on their compatibility in the carrier medium (i.e. aqueous based or solvent based) and on the compatibility with the oleophilizing agent i.e. they should not lead to coagulation.

The present invention will now be illustrated by the following examples without however being limited thereto.

EXAMPLES

Example 1

Preparation of the Printing Plate Precursor

A 0.30 mm thick aluminum foil was degreased by immersing the foil in an aqueous solution containing 5 g/l of sodium hydroxide at 50° C. and rinsed with demineralized water. The foil was then electrochemically grained using an alternating current in an aqueous solution containing 4 g/l of hydrochloric acid, 4 g/l of hydroboric acid and 5 g/l of aluminum ions at a temperature of 35° C. and a current density of 1200 A/m$^2$ to form a surface topography with an average center-line roughness Ra of 0.5 mm.

After rinsing with demineralized water the aluminum foil was then etched with an aqueous solution containing 300 g/l of sulphuric acid at 60° C. for 180 seconds and rinsed with demineralized water at 25° C. for 30 seconds.

The foil was subsequently subjected to anodic oxidation in an aqueous solution containing 200 g/l of sulphuric acid at a temperature of 45° C., a voltage of about 10 V and a current density of 150 A/m$^2$ for about 300 seconds to form an anodic oxidation film of 3.00 g/m$^2$ of $Al_2O_3$, then washed with demineralized water and posttreated with a solution containing polyvinylphosphonic acid rinsed with demineralized water at 20° C. during 120 seconds and dried.

A coating solution was prepared by mixing the following ingredients:

| | |
|---|---|
| Water | 3.71 g |
| Isopropanol | 5.56 g |
| Methyl ethyl ketone | 6.62 g |
| 16.3% solution of a aryldiazosulfonate copolymer (see formula below) in a mixture of water/isopropanol (40/60) | 3.49 g |
| 1% solution of Patent Blau V in methyl ethyl ketone | 5.63 g |

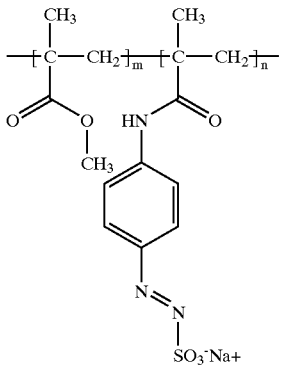

Formula Aryldiazosulphonate

The coating solution was coated onto the lithographic support prepared as explained above, and dried.

Preparation of the Fluid

The fluid was prepared by dissolving 8 g of compound A-1 (see formulas furtheron) in a mixture of 90 g of water and 10 g of isopropanol. After filtering the solution was loaded into the ink cartridge of an Epson Stylus Color 900 ink-jet printer, the cartridge having previously been emptied and cleaned.

A test pattern containing a text image was jetted onto the printing plate precursor which had been loaded into the Epson Stylus Color 900 ink-jet printer.

Next the plate was mounted on a Heidelberg GTO46 press using ROTA-MATIC (available from Unigraphica GmbH) as fountain and K+E 800 Skinnex Black (available from BASF) as ink. First the plate was contacted for 10 revolutions with the fountain rollers, than the ink rollers were dropped. And after 10 more revolutions paper was fed. The non imaged areas were removed during the start-up. Excellent copies were obtained.

Example 2

Preparation of the Printing Plate Precursor

The following coating composition was coated on the lithographic support described in example 1 at a wet coverage of 30 g/m$^2$, and dried at 35° C.

Preparation of the coating composition:

To 7.5 g of a 20% w/w dispersion of polystyrene (particle diameter of 60 nm) stabilized with a surfactant (1.5% w/w vs. polymer) in deionized water was added 20 g of a 1% w/w solution of infra-red dye I (see formula below).

To the above obtained solution was added 66.5 g deionized water and 6 g of a 5% w/w solution of CARBOPOL WS801 (polyacrylic acid commercially available from Goodrich).

Infra-red dye I

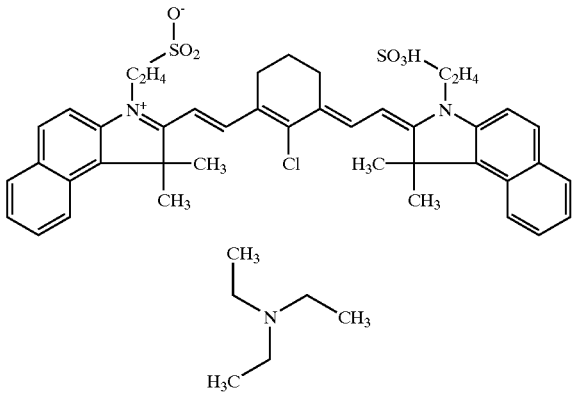

Preparation of the Fluid

The fluid was prepared by dissolving 8 g of A-1 in a mixture of 90 g of water and 10 g of isopropanol. After filtering the solution was loaded into the ink cartridge of an Epson Stylus Color 900 ink-jet printer, the cartridge having previously been emptied and cleaned.

A test pattern containing a text image was jetted onto the image forming which had been loaded into the Epson Stylus Color 900 ink-jet printer.

Next the plate was mounted on a Heidelberg GTO46 press using ROTA-MATIC (available from Unigraphica GmbH) as fountain and K+E 800 Skinnex Black (available from BASF) as ink. First the plate was contacted for 10 revolutions with the fountain rollers, than the ink rollers were dropped. And after 10 more revolutions paper was fed. The non-imaged areas were removed during the start-up. Excellent copies were obtained.

Examples 3 to 12

The insolubilizing capacity of several insolubilizing compounds (see formulas below) was tested using the following procedure.

The insolubilizing compound was dissolved in a solvent carrier at a concentration of 1%. Next a 6 $\mu$l droplet of each fluid was jetted on the printing plate precursor as defined in example 1. The droplet was dried at room temperature to remove the solvent carrier of the fluid. Next the plate was mounted on the press and the printing procedure as described in example 1 was used.

If the droplet-area of the image forming layer is ink-accepting, the compound is suitable for use in this invention.

| Example | Compound | Droplet-area remains on the lithographic support and accepts ink |
|---|---|---|
| 3 | Flexo Blue 630 | Yes |
| 4 | Crystal Violet | Yes |
| 5 | Acridine Orange Base | Yes |
| 6 | A-1 | Yes |
| 7 | A-2 | Yes |
| 8 | A-3 | Yes |
| 9 | A-4 | Yes |
| 10 | A-5 | Yes |
| 11 | A-6 | Yes |
| 12 | A-7 | Yes |

Formulas of compounds A-1 to A-7

A-1

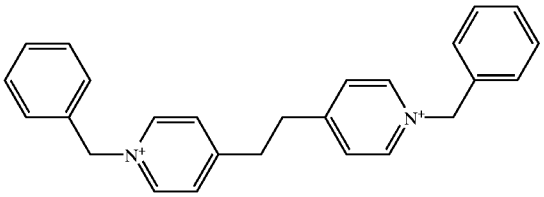

$[Cl^-]_2$

A-2

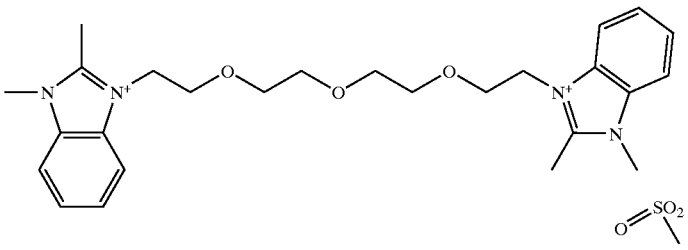

A-3

-continued

| Example | Compound | Droplet-area remains on the lithographic support and accepts ink |
|---|---|---|
| A-4 | 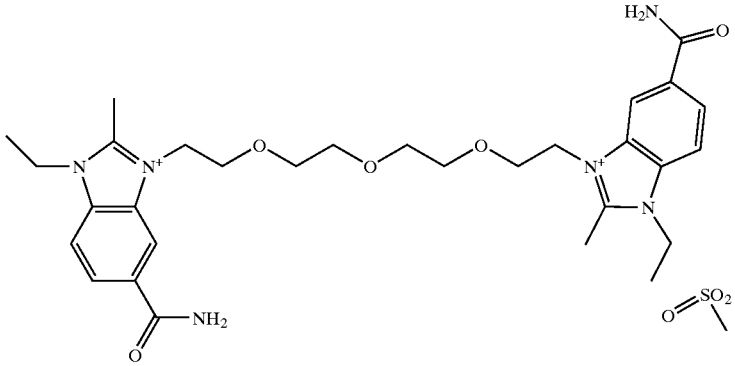 | |
| A-5 | 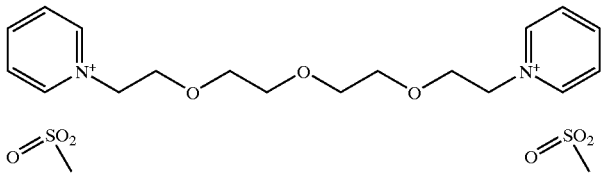 | |
| A-6 | 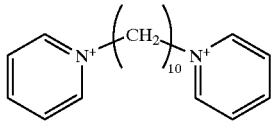 | |
| A-7 | 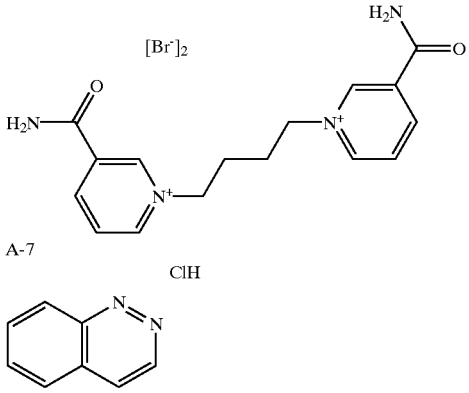 | |

What is claimed is:

1. A method for the preparation of a lithographic printing plate comprising the following steps, in order,:

(1) mounting on a printing press a printing plate precursor comprising a lithographic support and an image forming layer, capable of being dissolved and removed by the application of fountain and/or ink on said press, (2) prior to, or after step (1), dispensing image-wise by means of ink jet printing droplets of a fluid onto the surface of said lithographic printing plate precursor, characterized in that said fluid comprises in a solvent carrier a dissolution inhibitor compound capable of inhibiting or reducing the dissolving and removing action of fountain and/or ink on said image forming layer, (3) drying the plate precursor to at least partially remove the solvent carrier of said fluid, (4) applying fountain and/or ink onto the dried plate precursor, thereby removing the areas of said image forming layer, not imaged by ink jet printing, and simultaneously exposing the surface of said lithographic support, while retaining completely or at least partially the areas of said image forming layer, imaged by ink jet printing wherein said image forming layer contains an anionically stabilized compound.

2. A method according to claim 1 wherein said anionically stabilized compound is an anionically stabilized polymer or an anionic functional polymer.

3. A method according to claim 2 wherein said anionically stabilized polymer is chosen from a polymer dispersion, a polymer latex and a polymer bead.

4. A method according to claim 2 wherein said anionic functional polymer has a structural unit derived from a monomer having a functional group selected from a salt of sulphonic acid, a salt of sulphuric acid, a salt of phosphonic acid, a salt of phosphoric acid, and a salt of a carboxylic acid.

5. A method according to claim 4 wherein said monomer comprises an azosulphonate group.

6. A method according to claim 1 wherein said dissolution inhibitor is chosen from a N-quaternized N-containing compound, a N-containing heterocyclic compound, or a N-quaternized N-containing heterocyclic compound.

7. A method according to claim 6 wherein said N-quaternized N-containing heterocyclic compound is selected from the group consisting of imidazolinium compounds, quinolinium compounds, benzthiazolium compounds, and pyridinium compounds.

8. A method according to claim 7 wherein said N-quaternized N-containing heterocyclic compound is a bis-pyridinium compound.

9. A method according to claim 1 wherein said solubility of the image forming layer is not substantially influenced by incident UV radiation.

10. A method according to claim 1 wherein the surface of said lithographic support is metallic.

11. A method according to claim 10 wherein said metallic surface is a grained and anodized aluminum surface.

12. A method according to claim 1 wherein said lithographic support comprises a polymeric resin support and a crosslinked hydrophilic support.

13. A method according to claim 12 wherein said crosslinked hydrophilic layer comprises an inorganic pigment.

14. A method according to claim 13 wherein said inorganic pigment is chosen from an oxide or hydroxide of beryllium, magnesium, aluminum, silicon, gadolinium, arsenic, indium, tin, antimony, tellurium, lead, bismuth, titanium or a transition metal.

15. A method for the preparation of a lithographic printing plate comprising the following steps, in order,:

(1) mounting on a printing press a printing plate precursor comprising a lithographic support and an image forming layer, capable of being dissolved and removed by the application of fountain and/or ink on said press, (2) prior to, or after step (1), dispensing image-wise by means of ink jet printing droplets of a fluid onto the surface of said lithographic printing plate precursor, characterized in that said fluid comprises in a solvent carrier a dissolution inhibitor compound capable of inhibiting or reducing the dissolving and removing action of fountain and/or ink on said image forming layer, (3) drying the plate precursor to at least partially remove the solvent carrier of said fluid, (4) applying fountain and/or ink onto the dried plate precursor, thereby removing the areas of said image forming layer, not imaged by ink jet printing, and simultaneously exposing the surface of said lithographic support, while retaining completely or at least partially the areas of said image forming layer, imaged by ink jet printing wherein said dissolution inhibitor is an onium salt.

* * * * *